US006223878B1

(12) United States Patent
Cattani et al.

(10) Patent No.: US 6,223,878 B1
(45) Date of Patent: May 1, 2001

(54) METHOD AND APPARATUS FOR VALIDATING COINS

(75) Inventors: Thomas J. Cattani, King of Prussia, PA (US); Stephen John Dillon, Reading (GB)

(73) Assignee: Mars Incorporated, McLean, VA (US)

( * ) Notice: Subject to any disclaimer, the term of this patent is extended or adjusted under 35 U.S.C. 154(b) by 0 days.

(21) Appl. No.: 09/469,463

(22) Filed: Dec. 21, 1999

(30) Foreign Application Priority Data

Dec. 30, 1998 (GB) ..... 9828838

(51) Int. Cl.[7] ..... G07D 5/08
(52) U.S. Cl. ..... 194/317
(58) Field of Search ..... 194/317, 318, 194/319

(56) References Cited

U.S. PATENT DOCUMENTS 4,151,904 5/1979 Levasseur et al. .
5,244,070 9/1993 Carmen et al. .
5,351,798 10/1994 Hayes .
5,485,908 1/1996 Wang et al. .
5,526,918 6/1996 Dulligham et al. .
5,568,854 10/1996 Hayes et al. .
5,687,830 * 11/1997 Hayes et al. ..... 194/318
5,715,926 * 2/1998 Furneaux et al. ..... 194/317
5,833,402 * 11/1998 Baitch et al. ..... 194/317

* cited by examiner

*Primary Examiner*—Robert P. Olszewski
*Assistant Examiner*—Bryan Jaketic
(74) *Attorney, Agent, or Firm*—Fish & Richardson P.C.

(57) ABSTRACT

A coin validator is arranged to sample the outputs of electromagnetic sensors in order to derive measurements for use in testing coins. Frequency measurements are made by counting a predetermined number of oscillator cycles, terminating the sample period in response to this count being reached, and taking into account the duration of the sampling period and the number of cycles of the oscillator during the sampling period, including any cycles which may have occurred following the predetermined number. The predetermined number is altered in order to change the sampling period.

12 Claims, 3 Drawing Sheets

METHOD AND APPARATUS FOR VALIDATING COINS

FIELD OF THE INVENTION

This invention relates to a method and an apparatus for validating coins.

BACKGROUND OF THE INVENTION

It is known to validate coins by monitoring the outputs of a plurality of sensors each responsive to different characteristics of the coin, and determining that a coin is valid only if all the sensors produce outputs indicative of a particular coin denomination. Often, this is achieved by deriving from the sensors particular values indicative of specific parts of the sensor signal. For example, an electromagnetic sensor may form part of an oscillator, and the frequency of the oscillations may vary as a coin passes a sensor. In some arrangements, the peak value of the frequency variation is used as a parameter indicative of certain coin characteristics, and this value is compared with respective ranges each associated with a different coin denomination.

The peak frequency value is often obtained by taking successive samples of the output of the oscillator, and counting the number of cycles within each sample. The coin validator may have a microprocessor-based control circuit, and the microprocessor may be used for this counting operation in addition to other functions, such as checking that the measurements of the coin correspond to those of a valid coin.

FIG. 2 shows one prior art counting technique. The oscillator output is represented by successive cycles 1, 2, 3 . . . n of a waveform. At the leading edge of the first cycle, a timer is started. This measures a predetermined interval T, which may for example be 1mS. A second timer is also started at the same instant. Also, a counter starts to count the cycles of the waveform.

When the first timer has timed the predetermined period T, the microprocessor monitors the input waveform until the beginning of the next leading edge. At that point, the second timer is stopped, and the counter is also stopped. Assuming that the second timer has reached a value of t and the counter has reached the value n, the input frequency is given by n/t.

The use of the first counter ensures that the sample time is always approximately equal to T irrespective of the input frequency, and therefore cannot occupy an unduly long period, which would cause problems to other aspects of the validator operation.

In the alternative prior art arrangements shown in FIG. 3, a first timer is started at an arbitrary time and measures a predetermined period T. A second timer is started at the same time, and measures the period $e_1$ to the leading edge of the next pulse. A counter is also started, for counting the cycles of the oscillator. When the first timer reaches the predetermined time T, a further timer measures the period $e_2$ from the end of that period to the beginning of the next leading edge. The counter is then stopped.

In this arrangement, the frequency of the oscillator is given by $n/(T-e_1+e_2)$.

In both these arrangements, the timers operate at clock rates much higher than that of the frequency being measured, and both arrangements allow for precise measurement of frequency. However, each requires a plurality of timers, and each requires the processor to monitor the input waveform for the precise time at which the final leading edge is present.

The predetermined time period T is chosen to provide a compromise between a relatively accurate measurement, requiring a long sample time, and speed of operation, which may be crucial if the microprocessor has to perform other tasks at the same time.

SUMMARY OF THE INVENTION

Various aspects of the invention are set out in the accompanying claims.

According to a further aspect of the invention, the frequency of an oscillator coupled to an inductive sensor in a coin validator is measured by counting the number of oscillator cycles within a sample time period, which number may vary timing the sample period, which may also vary, and calculating the frequency from the cycle count and the timed duration, wherein the sample period is controlled in response to the counting of the oscillator cycles.

This avoids the need for a separate timer for ensuring that the sample period is of a substantially uniform duration. Although, in accordance with this further aspect of the invention, the sample period may vary, it is found in many applications that a coin passing an inductive sensor does not cause the frequency to change by more than a relatively small amount, so that the variation in sample time is not substantial. This sample time may for example vary by around 10%, depending upon the construction of the coin validator and the nature of the coins it is arranged to validate.

In a preferred aspect of the invention, the sample period is terminated in response to the count of the oscillator cycles reaching a predetermined number N, but the sample period does not necessarily terminate exactly at that point; it may terminate at a subsequent oscillator cycle. Meanwhile, the oscillator cycles continue to be counted so that the subsequent measurement of frequency is accurate. This preferred aspect of the invention could be implemented by arranging for a flag to be set when the counter of the oscillator cycles reaches N. At a subsequent point. the microprocessor checks the state of the flag, and if it is set the microprocessor then arranges for the timer and the counter to halt when the next oscillator cycle occurs. This means that the microprocessor can perform other tasks in the period between the oscillator count reaching N and the time at which the sample period ends. This has two possible advantages. First, it means that time-critical operations performed by the microprocessor do not have to be interrupted, or only have to be interrupted for a very brief period, in order to carry out the frequency measurement. Second, the microprocessor could be arranged to lengthen the sample period, if time is available, so as to increase the accuracy of the frequency measurement.

Other aspects of the invention may be used in conjunction with the aspects mentioned above, or may be used independently, for example with prior art counting techniques such as those described earlier.

In accordance with such a further aspect of the invention, a coin validator is operable to sample the output of a sensor for an alterable sampling period. By allowing the period to be altered, it is possible to make the sampling period suitable for different circumstances.

In one preferred arrangement, the coin validator comprises at least two sensors which are passed in succession by a coin. The output of at least the second sensor is sampled for a relatively long sample period, giving a high resolution, to obtain measurements used in the validation of the coin. During the time that the second sensor output is being sampled (which could last for several sample periods), there are one or more intervals in which the first sensor output is sampled in order to determine whether a second coin is adjacent the first sensor. This situation, wherein a first coin is followed in close proximity by a second coin, results in unreliable validation and therefore it useful to sense this circumstance so that both coins can be rejected. According to a preferred arrangement of the present invention, the first sensor is sampled for only a brief sampling period, thereby providing a low resolution. However, as the purpose of this sampling is simply to detect the presence of a coin, rather than to determine accurately the measurements of the coin, this is adequate. The short sampling period enables the operation to be performed quickly.

In a further aspect of the invention, a coin validator can be set up to validate any of a plurality of different coin sets. For example, a coin validator may be programmed to handle, selectively, either a British coin set or a German coin set. This could be achieved by storing the appropriate acceptance criteria in the validator, or by switching between two different sets of acceptance criteria. In accordance with the further aspect of the invention, the sampling period used for the sampling of the output of a coin sensor is dependent upon the coin set with which the coin validator is designed to operate. This could for example be achieved by storing, with the acceptance criteria, a value used to determine the sampling period. Thus, a high resolution measurement can be selected for coin sets including coins in which the peak response of different coins differs by a small amount, whereas a high-speed, low resolution sampling can be selected for coin sets in which coins exhibit sharp peaks in the response curves of the oscillator.

Other possibilities include changing the sampling period for the output of a particular sensor in dependence upon the likely denomination of the coin, as determined by some preceding test. Accordingly, if the initial determination is that the coin is likely to be of a denomination which exhibits a sharp peak, then the sampling period for the subsequent sensor can be reduced so that more low-resolution measurements can be taken, so as to obtain reliably a measurement which is representative of the peak. A further alternative is to change the sampling period as the coin passes the sensor, so that for example the sampling period is reduced as the sensor output waveform approaches the peak, to ensure that the peak measurement is not swamped by samples taken before or after the peak.

Arrangements embodying the invention will now be described by way of example with reference to the accompanying drawings, in which:

DETAILED DESCRIPTION OF THE DRAWINGS

Figure 1:
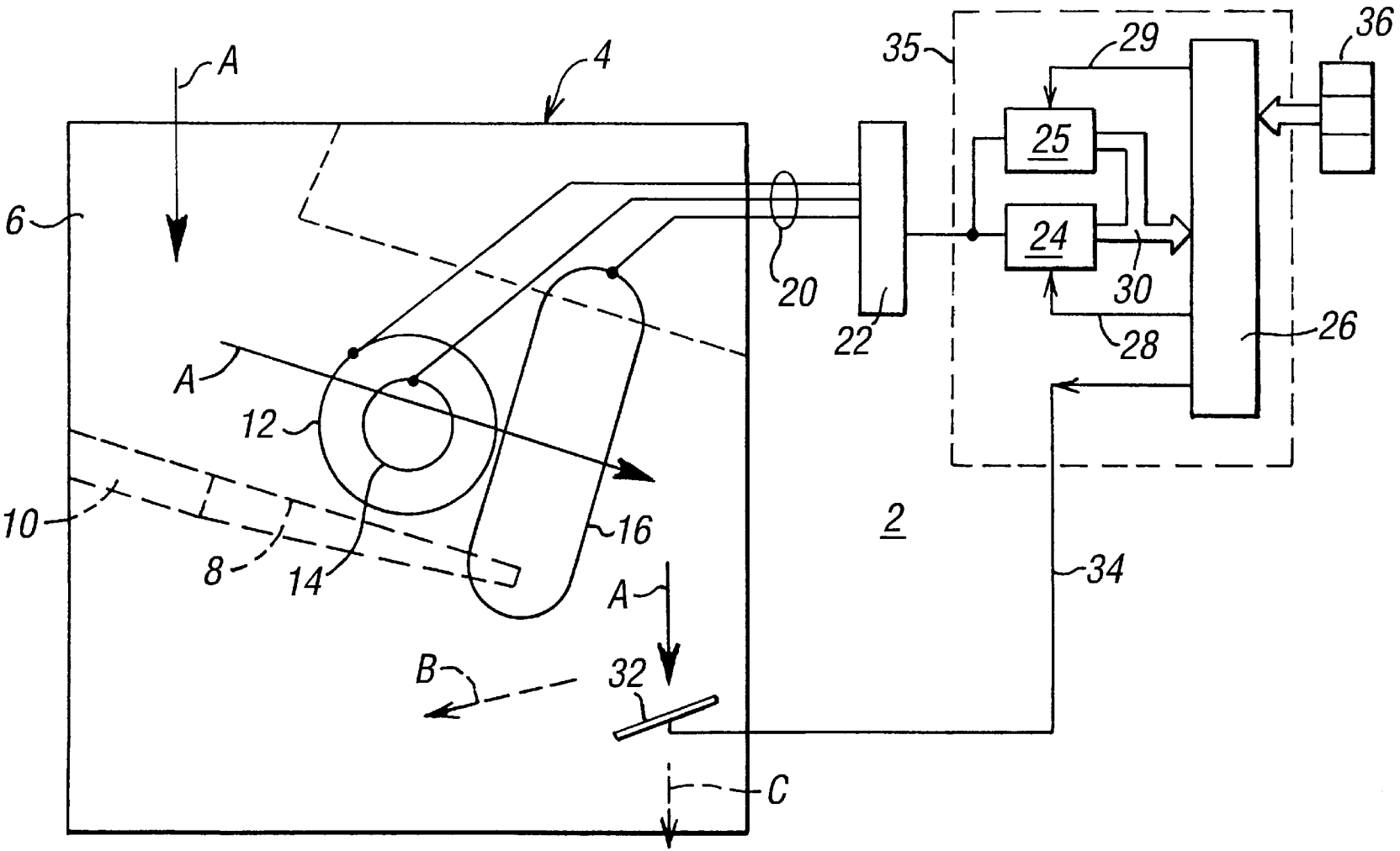
FIG. 1 schematically shows a coin validator in accordance with the invention.
Figure 2:
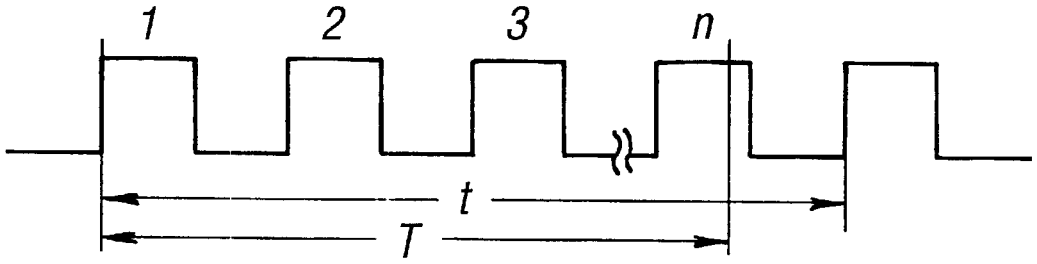
FIG. 2 (PRIOR ART)
FIGS. 2 and 3 illustrate different prior art techniques for measuring frequency.
Figure 3:
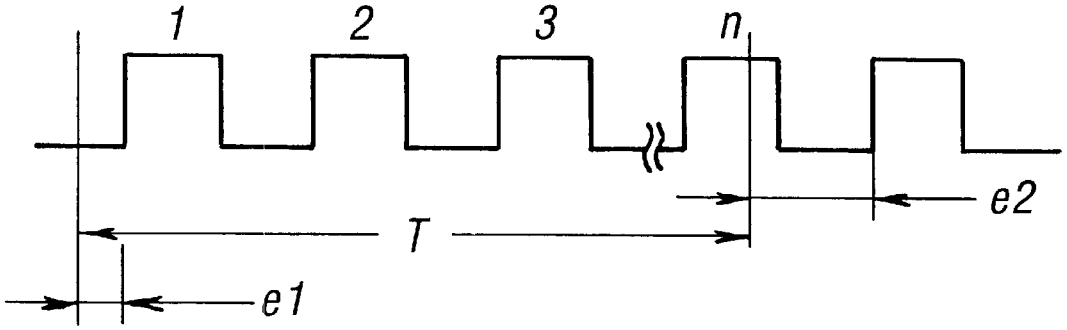
FIG. 3 (PRIOR ART)

Referring to FIG. 1, the validator 2 comprises a test structure 4. This structure comprises a deck (not shown) and a lid 6 which is hingedly mounted to the deck such that the deck and lid are in proximity to each other. FIG. 1 shows the test structure 4 as though viewed from the outer side of the lid. The inner side of the lid is moulded so as to form, with the deck, a narrow passageway for coins to travel edge first in the direction of arrows A.

The moulded inner surface of the lid 6 includes a ramp 8 along which the coins roll as they are being tested. At the upper end of the ramp 8 is an energy-absorbing element 10 positioned so that coins received for testing fall on to it. The element 10 is made of material which is harder than any of the coins intended to be tested, and serves to remove a large amount of kinetic energy from the coin as the coin hits the element.

As the coin rolls down the ramp 8, it passes between inductive sensors formed by three coils 12, 14 and 16 mounted on the lid, and a corresponding set of coils (not shown) of similar configuration and position mounted on the deck, forming three pairs of opposed coils. The coin is subjected to electromagnetic testing using these coils.

The coils are connected via lines 20 to an interface circuit 22. This interface circuit 22 comprises oscillators coupled to the electromagnetic sensors formed by coils 12, 14 and 16, circuits for appropriately filtering and shaping the signals from lines 20 and a multiplexing circuit for delivering any one of the signals from the three pairs of coils to an analog-to-digital converter 24 and to a counter 25.

A control circuit 26 has an output line 28 connected to the analog-to-digital converter 24, and is able to send pulses over the output line 28 in order to cause the analog-to-digital converter 24 to take a sample of its input signal and provide the corresponding digital output value on a data bus 30, so that the amplitude of the signal applied to the analog-to-digital converter 24 can be measured.

The control circuit 26 also has an output line 29 which can start and stop the counter 25, so that the oscillations of the signal applied to the counter can be counted for a predetermined period, whereby the frequency of the signal is converted to a digital value provided on the data bus 30 to the control circuit 26.

In this way, the control circuit 26 can obtain digital readings representing amplitude and frequency from the test structure 4, and in particular from the coils 12, 14 and 16, and can process these digital values in order to determine whether a received test item is a genuine coin or not. If the coin is not determined to be genuine, an accept/reject gate 32 will remain closed, so that the coin will be sent along the direction B to a reject path. However, if the coin is determined to be genuine, the control circuit 26 supplies an accept pulse on line 34 which causes the gate 32 to open so that the accepted coin will fall in the direction of arrow C to a coin separator (not shown), which separates coins of different denominations into different paths and directs them to respective coin stores (not shown).

In this embodiment, a single analog-to-digital converter 24 and a single counter 25 are used in a time-sharing manner for processing the signals from the coils 12, 14 and 16. However, a plurality of converters and counters could be provided if desired. Preferably, the control circuit 26, the analog-to-digital converter 24 and the counter 25 are embodied in a single microprocessor integrated circuit, e.g. a device of the Atmel AtMega family or the Hitachi H8S family or an Intel 80C51FA.

It is well known to take measurements of coins and apply acceptability tests to determine whether the coin is valid and the denomination of the coin. The acceptability tests are normally based on stored acceptance data. One common technique (see, e.g. GB-A-1 452 740) involves storing "windows", i.e. upper and lower limits for each test. If each of the measurements of a coin falls within a respective set of upper and lower limits, then the coin is deemed to be acceptable. The acceptance data could instead represent a predetermined value such as a median, the measurements then being tested to determine whether they lie within predetermined ranges of that value. Alternatively, the acceptance data could be used to modify each measurement and the test would then involve comparing the modified result with a fixed value or window. Alternatively, the acceptance data could be a look-up table which is addressed by the measurements, and the output of which indicates whether the measurements are suitable for a particular denomination (see, e.g. EP-A-0 480 736, and U.S. Pat. No. 4,951,799). Instead of having separate acceptance criteria for each test, the measurements may be combined and the result compared with stored acceptance data (cf. GB-A-2 238 152 and GB-A-2 254 949). Alternatively, some of these techniques could be combined, e.g. by using the acceptance data as coefficients (derived, e.g. using a neural network technique) for combining the measurements, and possibly for performing a test on the result. A still further possibility would be for the acceptance data to be used to define the conditions under which a test is performed (e.g. as in U.S. Pat. No. 4,625,852).

It is known to use statistical techniques for deriving the acceptance data, e.g. by feeding many items into the validator and deriving the data from the test measurements in a calibration operation. It is also known for the validator to have an automatic re-calibration function, sometimes known as "self-tuning", whereby the acceptance data is regularly updated on the basis of measurements performed during testing (see for example EP-A-0 155 126, GB-A-2 059 129, and U.S. Pat. No. 4,951,799). Normally, the acceptance data produced by the calibration operation are characteristic of the specific type of item to be validated. However, it is alternatively possible for the data to be independent of the properties of the item itself, and instead to be characteristic of just the validation apparatus (e.g. to represent how much the apparatus deviates in its measurements from a standard) so that this data in combination with further data representing the standard properties of an item are sufficient for validation.

In the present embodiment, in order to determine whether an inserted coin is genuine, and the denomination of the inserted coin, the control circuit 26 uses data derived from an EPROM 36. The EPROM has a number of different sections, each containing acceptance data for a respective set of coin denominations. In a set-up operation, one of these sections is selected for use by the controller 26. The acceptance data in this embodiment takes the form of a pair of upper and lower limits for each of the measurements derived from the sensors for each coin denomination. A coin is determined to be a valid coin of a particular denomination if the measurements all fall within the respective pairs of limits for that denomination.

In addition to this data, the EPROM 36 also stores, for each coin set, a set of values (referred to herein as "sampling period values" n, n', n", etc.) which are used to determined the approximate length of the sampling periods used for frequency measurements. In the current embodiment, these values are used to determine the approximate sampling period for each frequency measurement from each of the coils 12, 14, 16. However, the same, or a different, value may be used for determining a sampling period used for amplitude measurement of the outputs of the coils. Also, if desired, different values could be stored for the respective coils, to permit different frequency and/or amplitude sampling periods to be used.

Figure 4:
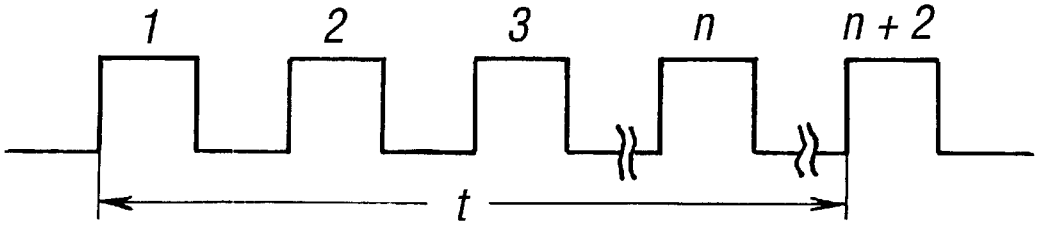
FIG. 4 is a diagram illustrating a measuring technique according to the present invention.
Figure 5:
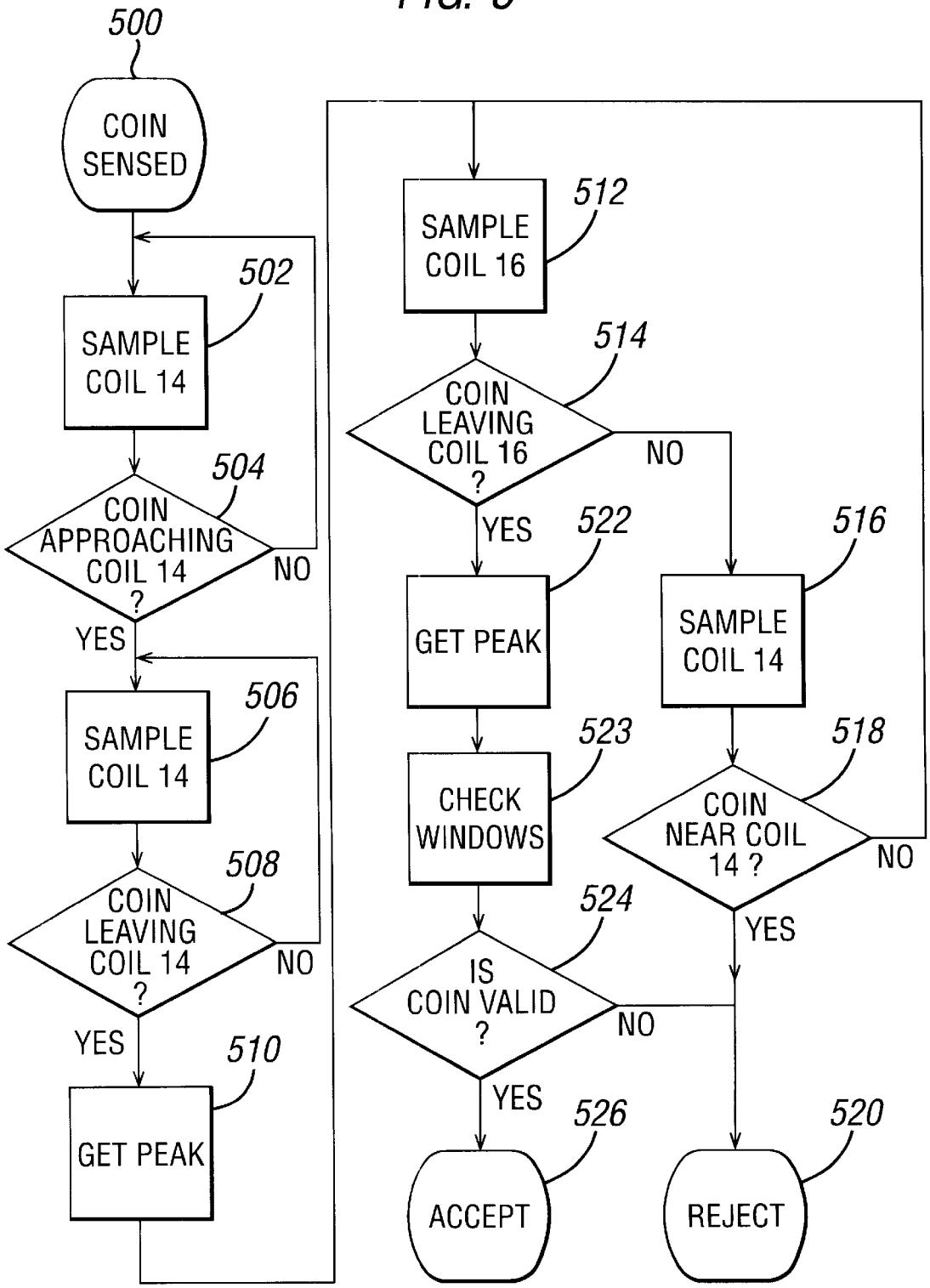
FIG. 5 is a flow chart of part of the operation of the validator.

The operation of the validator will now be described with reference to FIGS. 4 and 5 of the accompanying drawings. FIG. 5 is a flow chart showing part of the operation of the microprocessor of the control circuit 26. It should be noted that the microprocessor is arranged to perform simultaneously a number of tasks. For example, the frequency and amplitude measurements for each coil are performed by sampling, with the frequency samples being interleaved with the amplitude samples. Also, the measurements from the coils 12 and 14 are taken during the same period. In addition, while taking measurements from the coils, other operations can be performed, such as checking the outputs of coin store level sensors, checking for error conditions, etc. The control of the multi-tasking operation of the microprocessor can be performed in any of a number of known ways, for example, by using timerbased interrupts.

FIG. 5 is intended to show primarily those routines which are related to the determination of the frequency of the oscillators coupled to the coils 14 and 16 and the counterpart coils on the deck. Although the operations shown in FIG. 5 occur sequentially as illustrated, the microprocessor also carries out other operations at the same time (e.g. measuring the output of coil 12, taking amplitude measurements from coils 14 and 16, checking level sensors, etc.), although these operations are not shown for the purposes of clarity, and because their timing with respect to the individual operations shown in FIG. 5 may vary. This type of multi-tasking operation is common in the controllers of coin validators and will be familiar to anyone skilled in the art.

The processor sequence of FIG. 5 starts at step 500, which occurs when the microprocessor has determined that a coin is likely to arrive soon at the coil 14, for example in response to a signal from the coil 12.

At step 502, the microprocessor (a) sends an instruction on line 29 to the counter 25 to enable it to start counting oscillator cycles, and (b) waits for the leading edge of the next oscillator cycle as received from interface circuit 22 before starting an internal timer. The interface circuit is currently delivering pulses from the oscillator connected to coil 14.

Then, within step 502, the microprocessor periodically checks the output of the counter 25 until this reaches a value n. This value n has been previously read from the EPROM 36 during the setting-up operation. When the counter reaches n, the microprocessor sets a flag. Thereafter, the microprocessor periodically checks for a leading edge of an oscillator cycle, and when such a leading edge is found, the internal timer is stopped, and a signal is sent on line 29 to stop the counter 25. In the interval between the count n having been reached and the stopping of the counter, it is possible that one or more additional cycles will occur, particularly if the microprocessor is busy with other tasks. Assuming that x further cycles occur, and the timer has timed a period t, the frequency is determined to be $(n+x)/t$.

Step 502, therefore, results in a sampling operation being carried out for, substantially, a time period corresponding to n cycles of the oscillator frequency. The actual sampling period may vary to some extent as a result of frequency variation, and because the number x is indeterminate, but the largest influence on the length of the sampling period is this value n.

The program then proceeds to step 504. Here, the microprocessor determines whether the coin is beginning to approach the coil 14, i.e. whether the frequency is tending away from the idle frequency which is adopted in the absence of a coin. The steps 502 and 504 are repeated until it is determined that the coin is starting to approach the coil 14.

The first time step 502 is executed, the calculated frequency represents the idle frequency, and this value is stored. However, the frequencies calculated in successive executions of step 502 do not need to be stored.

Step 506 is similar to step 502, except that in each execution of step 506 the frequency measurement is stored in an internal memory. Step 508 is similar to step 504, except that the processor is determining when the coin is starting to leave the coil 14.

At step 510, after the coin starts to leave the coil 14, the peak variation in the frequency is determined from the set of frequency values stored during the successive executions of step 506.

At step 512, another sampling operation is performed. This is similar to the sampling operation performed in step 506, except that now it is the frequency of coil 16 which is being checked. Also, the sample period is different, because the microprocessor has retrieved, for coil 16, a sampling period value n', which is different from n. This may be because less resolution is required for the frequency measurement of coil 16.

At step 514, the microprocessor determines whether the coin is starting to leave the coil 16. If not, the program proceeds to step 516. This step is similar to the sampling step 502, and samples the frequency output of coil 14. However, the sampling value derived from the EPROM 36 for the purposes of step 516 is equal to n", which is smaller than n. Accordingly, this sampling period is significantly shorter than the sampling period used in steps 502 and 506 for sampling the output of sensor 14. This means that the microprocessor does not require much time to perform this sampling operation.

At step 518, it is determined whether the frequency measurement made in step 516 indicates that a coin is adjacent the coil 14. This can be done by determining whether the frequency measurement is significantly different from the idle frequency. If so, it is determined that the coins adjacent the coils 14 and 16 are too close together for reliable validation, and the program proceeds to step 520 which results in the issuing of a signal to reject the coins.

If there is no closely-following coin as determined at step 518, the program loops back to step 512.

This sequence continues until the coin is detected at step 514 to be leaving the coil 16, whereupon the program proceeds to step 522 to determine the peak frequency of the output of the coil 16.

At step 523, all the measurements from the coils are retrieved and compared with the window limits retrieved from the EPROM 36, and at step 524 it is determined whether the measurements represent a valid coin or not. If not, the program proceeds to the rejection routine 520. Otherwise, the program proceeds to step 526, which results in the issuing of an acceptance signal and a signal representing the denomination of the received coin.

In an alternative embodiment, the set-up operation involves retrieving from the EPROM 36 a set of values $n'_{i,j}$, instead of the single value n'. At the step 510, the microprocessor makes a preliminary determination of the likely denomination of the coin, based on the amplitude and/or frequency measurements taken from the coils 12 and/or 14. Assuming that the coin is determined to be, possibly, of denomination D, then the microprocessor selects a subset of sample period values $n'_{D,j}$ for use in the sampling operations performed in step 512. The first of these values $n'_{D,1}$ is then chosen for initial use.

Then, at step 512, a sampling operation is carried out on the basis of the sampling period value $n'_{D,1}$.

Each time step 516 is reached, the microprocessor assesses the point reached by the coin in its passage past the coil 16. This assessment can for example be based on the amount by which the currently-measured frequency varies from the idle frequency. Depending upon the point reached, the microprocessor then selects another value, for example $n'_{D,2}$, $n'_{D,3}$, etc. for use in the next sampling operation performed at step 512.

This alternative embodiment therefore varies the sampling period in response to two additional parameters, namely (1) the preliminary assessment of denomination, and (2) the passage of the coin past the sensor coil. It would be possible to use only one of these parameters for controlling the selection of the sampling period value.

These embodiments have been described in the context of coin validators, but it is to be noted that the term "coin" is employed to mean any coin (whether valid or counterfeit), token, slug, washer, or other metallic object or item, and especially any metallic object or item which could be utilised by an individual in an attempt to operate a coin-operated device or system. A "valid coin" is considered to be an authentic coin, token, or the like, and especially an authentic coin of a monetary system or systems in which or with which a coinoperated device or system is intended to operate and of a denomination which such coin-operated device or system is intended selectively to receive and to treat as an item of value.

What is claimed is:

1. A coin validator comprising a coin sensor and means for sampling the output of the sensor, so that a measurement of the coin can be taken by sampling as the coin passes the sensor, wherein the sampling means is arranged to perform a sampling operation for substantially a predetermined sampling period, and characterised by means for altering the predetermined sampling period.

2. A coin validator as claimed in claim 1, including a further sensor, and means for reading the output of the further sensor as the coin passes the further sensor in order to take a further measurement, wherein the sampling means is operable to sample the output of the coin sensor for substantially a first sampling period during a first interval while the coin is passing the coin sensor to take a measurement, and is further operable to sample the output of the coin sensor for substantially a second, different, sampling period during a subsequent interval in which the further measurement is being taken.

3. A coin validator as claimed in claim 2, wherein the means for reading the output of the further sensor comprises said sampling means.

4. A coin validator as claimed in claim 1, including a further sensor, said sampling means being operable to sample the outputs of the coin sensor and the further sensor for, substantially, different predetermined sampling periods.

5. A coin validator as claimed in claim 1, including means for storing acceptance criteria for a plurality of coins, the acceptance criteria including data defining said predetermined sampling period.

6. A coin validator as claimed in claim 1, wherein the altering means is responsive to a preliminary assessment of coin denomination for selecting a sampling period.

7. A coin validator as claimed in claim 1, wherein the altering means is operable to alter the sampling period as the coin passes the coin sensor, so that successive readings are taken at different resolutions.

8. A coin validator as claimed in claim 1, wherein the sampling means is operable to determine the frequency of an oscillator including said coin sensor by measuring the amount of time required for a predetermined plural number of cycles of the oscillator.

9. A coin validator as claimed in claim 8, wherein the sampling period is terminated in response to the counting of a predetermined number of oscillator cycles, and the altering means is operable to alter said predetermined number.

10. A coin validator as claimed in claim 9, wherein the sampling period is terminated at a brief period following the counting of said predetermined number of oscillator cycles, and the frequency determination takes into account any subsequently-occurring cycles in the sampling period.

11. A coin validator having an oscillator with a frequency which varies as a coin comes into proximity to a coin sensor, the frequency of the oscillator being used in the assessment of coin validity, wherein the frequency is measured by counting the number of oscillator cycles within a sampling period and by timing the sampling period, and wherein both the number of oscillator cycles and the sampling period may vary, and the sampling period is terminated in response to counting a predetermined number of oscillator cycles.

12. A coin validator having an oscillator with a frequency which varies as a coin comes into proximity to a coin sensor, the frequency of the oscillator being used in the assessment of coin validity, wherein the frequency is measured by counting the number of oscillator cycles within a sampling period, and by timing the sampling period, and wherein the sampling period is terminated in response to counting a predetermined number of oscillator cycles, wherein the frequency determination takes into account any oscillator cycles occurring following said predetermined number and prior to actual termination of the sampling period.

* * * * *